US007030543B2

(12) United States Patent
Galvez et al.

(10) Patent No.: US 7,030,543 B2
(45) Date of Patent: Apr. 18, 2006

(54) REFLECTOR LAMP HAVING REDUCED SEAL TEMPERATURE

(75) Inventors: Miguel Galvez, Danvers, MA (US); Walter P. Lapatovich, Boxford, MA (US)

(73) Assignee: Osram Sylvania Inc., Danvers, MA (US)

( * ) Notice: Subject to any disclaimer, the term of this patent is extended or adjusted under 35 U.S.C. 154(b) by 223 days.

(21) Appl. No.: 10/785,611

(22) Filed: Feb. 24, 2004

(65) Prior Publication Data

US 2005/0184632 A1 Aug. 25, 2005

(51) Int. Cl.
*H01J 1/02* (2006.01)

(52) U.S. Cl. ..... 313/25; 313/634

(58) Field of Classification Search ..... 313/17, 313/25, 493, 634, 635, 113
See application file for complete search history.

(56) References Cited

U.S. PATENT DOCUMENTS

| | | | | |
|---|---|---|---|---|
| 3,784,861 | A | 1/1974 | Notelteirs | 313/117 |
| 4,288,713 | A | 9/1981 | Marlor | 313/117 |
| 5,424,609 | A | 6/1995 | Geven et al. | 313/623 |
| 5,646,471 | A | 7/1997 | Schöller et al. | 313/25 |
| 5,936,351 | A | 8/1999 | Lang | 313/634 |
| 2003/0193280 | A1* | 10/2003 | Lapatovich et al. | 313/113 |

FOREIGN PATENT DOCUMENTS

| | | |
|---|---|---|
| JP | 1-107402 | 4/1989 |
| JP | 11-111037 | 4/1999 |
| JP | 2001-023427 | 1/2001 |

* cited by examiner

*Primary Examiner*—Vip Patel
(74) *Attorney, Agent, or Firm*—Robert F. Clark

(57) ABSTRACT

The seal temperature of a reflector lamp having a ceramic metal halide light source is reduced by a light absorbing layer which is provided in a region of the outer jacket adjacent to the electrode seal. Light reflected within the neck cavity of the reflector lamp impinges on the light absorbing layer and is absorbed before it can reach the electrode seal which is at least partially located in the neck of the reflector. The heat from the absorbed light is conducted into the base of the lamp to be dissipated in the socket.

20 Claims, 2 Drawing Sheets

REFLECTOR LAMP HAVING REDUCED SEAL TEMPERATURE

CROSS REFERENCES TO RELATED APPLICATIONS

This application is related to copending application Ser. No. 10/120,958, filed Apr. 11, 2002.

TECHNICAL FIELD

The present invention is related to light sources that are mounted within a reflector body. More particularly, this invention is related to reflector lamps having a ceramic metal halide light source.

BACKGROUND OF THE INVENTION

Ceramic metal halide light sources are comprised of a ceramic discharge vessel (commonly referred to as an arc tube) that is generally made of polycrystalline-alumina. Typical metal halide fills may include mercury, alkali- and alkaline-earth iodides, in particular NaI and $CaI_2$, and rare-earth iodides such as $DyI_3$, $TmI_3$ and $HoI_3$. Xenon or argon are typical gas fills. Tungsten electrodes are used to generate an arc within the discharge vessel. Because electrical power must be supplied to the electrodes, the electrode assemblies must extend through the arc tube wall. In a conventional construction, capillary tubes hold the electrode assemblies and a frit material is used to form a hermetic seal between the electrode assembly and its respective capillary. The ceramic arc tube is often jacketed in another envelope, called an outer jacket, to protect the metal parts from oxidation. These outer jackets are usually thermally isolated from the arc tube and contain a vacuum or are filled with a partial pressure of an inert gas and a getter material, e.g., an aluminum or zirconium compound, to getter hydrogen and oxygen.

In recent years, ceramic metal halide light sources have become increasingly favored because of their efficiency and color rendering properties. As a result, the applications for ceramic metal halide light sources have expanded into traditional incandescent lighting applications, such as parabolic reflector (PAR) lamps, which must be adapted to accommodate these high-intensity, high-temperature light sources. For example, a typical failure mode for ceramic metal halide sources occurs as a result of chemical attack by the metal halide fills on the frit materials used to make the electrode seals. In a conventional reflector lamp structure, this problem is exacerbated because some of the emitted visible radiation is reflected back onto the ceramic metal halide source, and in particular, the electrode seal located in the neck portion of the reflector. The construction of the electrode assembly and the seal make it a particularly good absorber of visible light. The absorbed energy causes the electrode seal to overheat which in turn increases the rate of chemical attack by the fill on the seal leading to premature lamp failure. Therefore, it would be advantageous to keep the electrode seal from overheating in order to extend the operating life of the lamp. It would be a further advantage to accomplish this without significantly affecting the performance or cosmetic appearance of the reflector lamp.

SUMMARY OF THE INVENTION

The present invention is a reflector lamp having a ceramic metal halide light source wherein a particular portion of the outer jacket of the ceramic metal halide source is provided with a light absorbing layer. Light reflected within the neck cavity of the reflector lamp impinges on the light absorbing layer and is absorbed before it can reach the electrode seal which is located at least partially in the neck cavity of the reflector lamp. The absorbed light raises the temperature of the outer jacket, but not the electrode seal. The heat generated by the absorbed light is conducted into the base of the reflector lamp to be dissipated in the socket.

In a preferred embodiment, the temperature of the electrode seal during operation of the reflector lamp is at least about 50° C. lower than the temperature would have been if the lamp were constructed without the light absorbing layer on the outer jacket. This invention is particularly applicable to those discharge vessels which have elongated seal structures.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
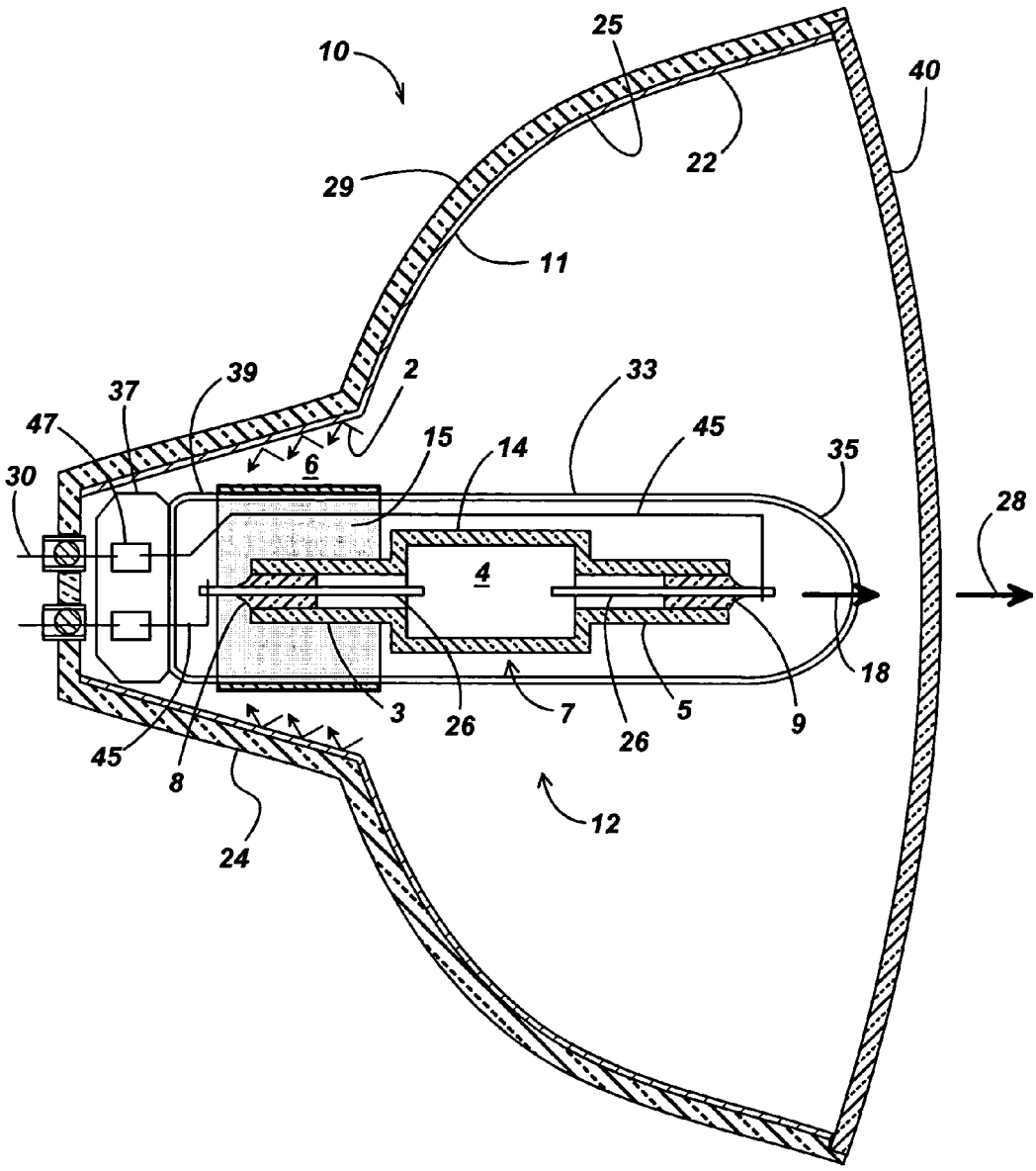
FIG. 1 is a cross-sectional view of a preferred embodiment of the reflector lamp of this invention.

FIG. 1 is a cross-sectional view of a preferred embodiment of the reflector lamp of this invention. The reflector lamp is comprised of reflector body 10 and light source 12. A lens 40 may or may not be attached to the forward edge of the reflector to enclose the light source 12 within the reflector body 10. The lens may be fused, glued, or similarly coupled to the reflector body as is known in the art. The reflector body 10 is comprised of concave shell 29 and neck 24 which defines neck cavity 6. The shell 29 surrounds the light source 12 to reflect light from the light source 12 onto a field to be illuminated during lamp operation. The reflector body 10 has a reflective surface 11 to reflect the light emitted from light source 12.

The reflective surface 11 is preferably formed by applying a reflective coating 22 to the reflector body's inner surface 25. The reflective coating 22 substantially covers the inner surface 25 including the neck 24 of the reflector body 10. Preferably, the inner surface 25 of the reflector has been aluminized or silvered to provide the reflective coating. Other typical reflective coatings include multi-layer dichroic coatings which are designed to reflect only certain portions of the spectrum of light emitted from the light source.

The reflector body is rotationally symmetric about a reflector axis 28. The concave shell may have a parabolic, elliptical or other similar optically functional cross section. The inner surface 25 of the reflector body 10 may be smooth, faceted or otherwise contoured to reflect the light in a preferred direction to yield a desired beam pattern. The neck 24 of reflector body 10 is provided with an electrical connection or connections 30 for providing power to light source 12; and a mechanical support or supports, which may be the same as the electrical connections. Preferably, the mechanical support holds light source 12 such that the axis 18 of the light source is substantially co-axial with the reflector axis 28.

The light source 12 is a ceramic metal halide source comprised of a double-ended discharge vessel 7 having an axially symmetric body 14 with two capillaries 3, 5 extending outwardly from the body 14 in opposite directions along axis 18. The axially symmetric body 14 defines an arc discharge cavity 4. In this embodiment, the body 14 has the shape of a right circular cylinder. However, other known shapes include spheroid geometries such as the one described in U.S. Pat. No. 5,936,351. Preferably, the discharge vessel 7 is composed of a polycrystalline alumina. Other ceramic vessels are feasible, e.g., yttrium aluminum garnet.

Each capillary 3,5 of the discharge vessel 7 contains an electrode assembly 26 which passes through it. Electrode seals 8, 9 are used to hermetically seal the electrode assembly 26 to its respective capillary 3, 5. The electrode assembly is usually composed of multiple metal sections, viz. niobium, molybdenum wire coiled on a molybdenum mandrel, and a tungsten rod with a tungsten coil at its end. The electrode seals are formed with a frit material which is a lower melting temperature ceramic composition, e.g., $Al_2O_3$, $Dy_2O_3$, and $SiO_2$. The coefficient of thermal expansion of the polycrystalline alumina, frit, and niobium are similar to minimize thermal stress in the seals. The frit is melted during a sealing operation and covers about 5 mm of the electrode assembly, including 3 mm of the niobium and 2 mm of the molybdenum coil on the molybdenum mandrel. It is the tight winding of the Mo wire over the Mo mandrel that provides a good absorber of visible light. Details of various electrode structures and seals are described in U.S. Pat. No. 5,424,609. The electrode assemblies protrude into discharge cavity 4 for the purpose of striking an electric arc between the opposing ends of the two electrode assemblies. At their opposite ends, the electrode assemblies extend beyond the ends of the capillaries to provide external electrical connections. The discharge cavity 4 contains mercury, a metal halide fill and a buffer gas. The metal halide fill typically comprises 5–10 mg of a mixture of metal halide salts, e.g., NaI, $CaI_2$, $HoI_3$, $DyI_3$, and $TmI_3$. The buffer gas may be Ar, Kr, Xe, or a mixture thereof, with a fill pressure of 10 to 400 torr.

Outer jacket 33 is transparent to visible light and is constructed of glass, e.g., fused silica (quartz) or an aluminosilicate glass. In this embodiment, outer jacket 33 has a tubular shape which is closed at both ends. The upper end 35 of the outer jacket is domed and the base end 39 contains press seal 37. The electrical leads 45 are connected to the external portion of the electrode assemblies 26. The leads 45 are welded to molybdenum foils 47 which are in turn welded to electrical connections 30 thereby providing a conductive path for connecting the light source 12 to an external power source (not shown). The molybdenum foils 47 are sealed within press seal 37 to provide a closed environment within the outer jacket 33. Eyelets may be located in the base of the neck to duct the electrical connections through the reflector body. The electrical connections may then be soldered in place. The outer jacket 33 may have a vacuum environment or be filled with a gas such as nitrogen gas. Filing the outer jacket with nitrogen gas has the effect of cooling the seal area, but it also cools the rest of the discharge vessel resulting in an undesirable color shift in the light output.

Light source 12 is oriented so that the base end 39 of outer jacket 33 is situated within the neck cavity 6 of the reflector body 10. Consequently, an end of the discharge vessel 7 containing an electrode seal, in this case defined by capillary 3 and electrode seal 8, is also at least partially situated within the neck cavity 6. In order to reduce the temperature of the electrode seal 8 during the operation of the lamp, a region of the outer jacket 33 adjacent to the electrode seal 8 is provided with light absorbing layer 15 which masks the electrode seal 8 from reflected radiation 2 within the neck cavity. Since the amount of radiation reaching the electrode seal in the neck cavity is reduced, the temperature of the electrode seal is lower. Preferably, the light absorbing layer 15 is continuous and extends circumferentially around the outer jacket 33 and lengthwise towards base end 39 from a point between 0.1 to 2 mm below the body 14 of the discharge vessel 7 covering the length of capillary 3. More preferably, the light absorbing layer starts 1 mm below the body 14 of the discharge vessel 7 so as not to interfere with the light gathering power of the reflector lamp.

Figure 2:
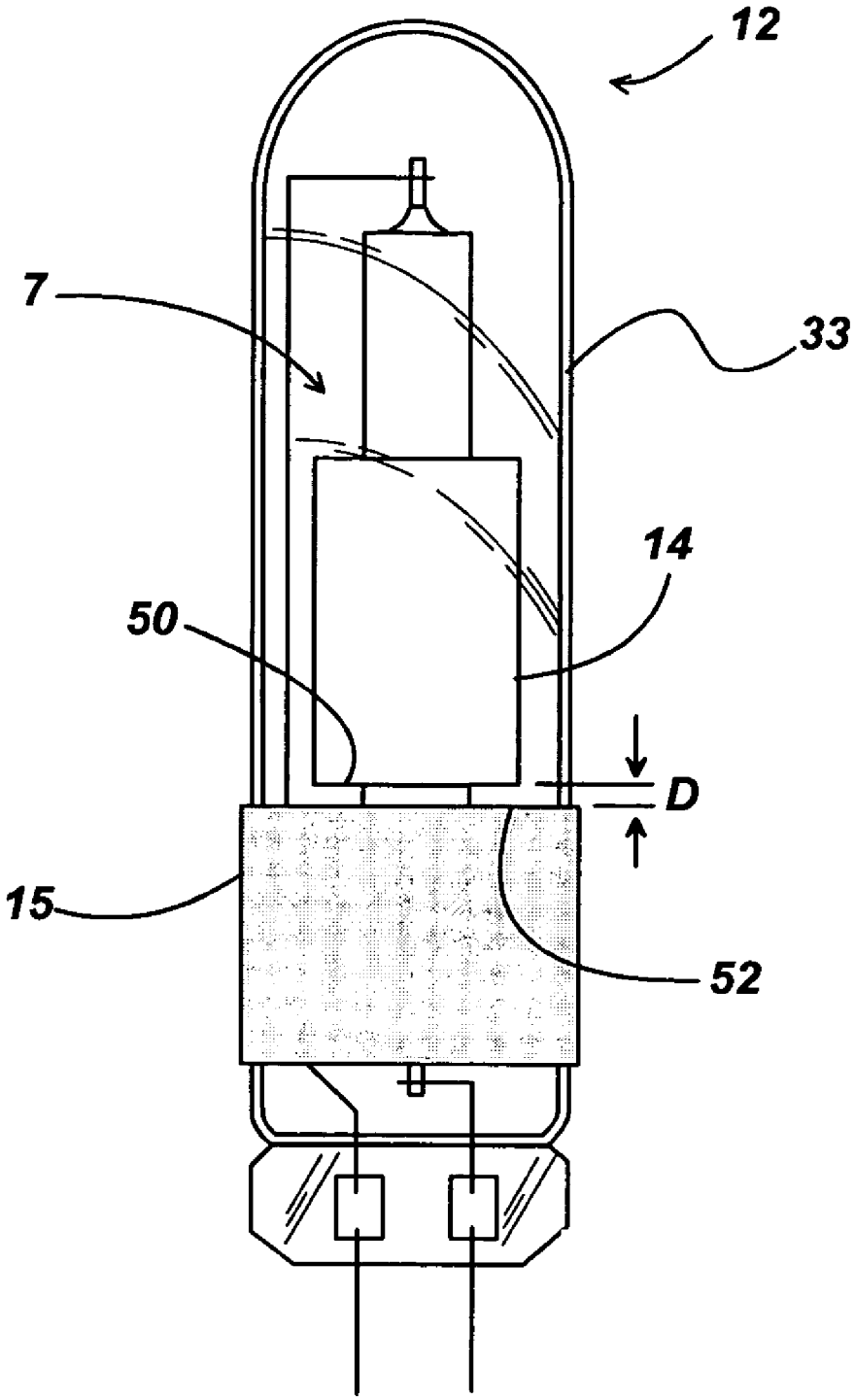
FIG. 2 is a side view of the light source of the reflector lamp shown in FIG. 1.

The placement of the light absorbing layer 15 may be better observed in FIG. 2 which is a side view of the light source 12 without the reflector body. The distance D represents an offset between the lower boundary 50 of the body 14 of discharge vessel 7 and the beginning edge 52 of the light absorbing layer 15. As stated above, this distance D is preferably 0.1 mm to 2 mm and more preferably 1 mm. The light absorbing layer 15 is preferably opaque and may be formed as an integral part of the glass outer jacket 33, e.g., dyeing or impregnating a region of the glass outer jacket with ions to alter the light absorbing properties of the glass, or incorporating a section of an opaque glass in the transparent outer jacket. The light absorbing layer 15 may be applied by brushing, spraying, dipping, electroplating, silk-screening or deposited by CVD or PCVD. Preferably, the light absorbing layer 15 is applied as an opaque coating to the exterior surface of the jacket as shown in FIGS. 1 and 2. The opaque coating comprises a refractory light-absorptive paint such as the automotive blacktop coating which is commonly used on the tips of halogen headlamps to control glare. Examples of the automotive blacktop coating may be found in U.S. Pat. Nos. 3,784,861 and 4,288,713. When cured, the black top coating forms a matte, dark gray or black surface. Such blacktop compounds may consist for example of an emulsion of Kaolin clay, silicon powder, aluminum phosphate and water, which cures to a durable coating upon baking. Other formulations may contain silicon, carbon, and iron powders dispersed in butanol and glycerin. Alternatively, the coating may be a high-temperature black paint capable of 315° C. (600° F.) continuous operation, for example Krylon BBQ and Stove paint, sold by Sherwin Williams of Cleveland, Ohio. The neutral gray or black absorptive coatings have very little reflection in the visible and so do not alter the color of the primary beam by scattering selective wavelengths.

The effectiveness of the light absorbing layer at reducing the temperature of the electrode seal in the neck cavity was measured by operating two groups of 70W PAR30 ceramic metal halide lamps in a vertical, base-up orientation. The first group consisted of control lamps that did not have the light absorbing layer on the outer jacket. The second group of lamps were fabricated according to this invention. The light absorbing layer was an automotive blacktop coating that had been painted onto the exterior surface of the outer jacket. A stripe about 3 mm wide and parallel to the capillary was removed to permit infrared viewing of the seal area in order to measure its temperature. On average, the temperature of the electrode seal in the neck cavity of the PAR 30 lamps was reduced by about 50° C. from about 890° C. to about 840° C. by the addition of the light absorbing layer to the outer jacket. Furthermore, by placing the light absorbing layer on the outer jacket instead of on the reflector body the cosmetic appearance of the reflector lamp is less affected.

While there has been shown and described what are at the present considered the preferred embodiments of the invention, it will be obvious to those skilled in the art that various changes and modifications may be made therein without departing from the scope of the invention as defined by the appended claims.

We claim:

1. A reflector lamp comprising:

a reflector body having a reflective surface, a concave shell, and a neck defining a neck cavity; and a light source having an outer jacket which encloses a ceramic discharge vessel having an electrode seal, the electrode seal being at least partially situated within the neck cavity of the reflector body, the outer jacket having a light absorbing layer in a region of the outer jacket adjacent to the electrode seal.

2. The reflector lamp of claim 1 wherein the concave shell defines a parabolic reflecting surface.

3. The reflector lamp of claim 1 wherein the electrode seal is comprised of a frit material.

4. The reflector lamp of claim 3 wherein the frit material comprises $Al_2O_3$, $Dy_2O_3$, and $SiO_2$.

5. The reflector lamp of claim 1 wherein the light absorbing layer lowers the temperature of the electrode seal during lamp operation by at least about 50° C.

6. The reflector lamp of claim 5 wherein the reflector lamp is a 70 watt PAR 30 reflector lamp.

7. The reflector lamp of claim 1 wherein the light absorbing layer comprises a refractory light-absorptive paint applied to the exterior surface of the outer jacket.

8. The reflector lamp of claim 1 wherein the light absorbing layer is continuous in the region of the outer jacket adjacent to the electrode seal.

9. The reflector lamp of claim 8 wherein the light absorbing layer covers the length of the electrode seal.

10. A reflector lamp comprising:

a reflector body having a reflective surface, a concave shell, and a neck defining a neck cavity;

a light source having an outer jacket enclosing a ceramic discharge vessel, the discharge vessel having a capillary and a body which encloses a discharge cavity containing a metal halide fill and a gaseous fill, the capillary extending outwardly from the body and containing an electrode assembly and an electrode seal, the electrode assembly passing through the capillary and being connectable to a power source, the electrode seal being at least partially situated within the neck cavity of the reflector, the outer jacket having a light absorbing layer in a region adjacent to the electrode seal.

11. The reflector lamp of claim 10 wherein the light absorbing light starts at a point between 0.1 mm and 2 mm below the body of the discharge vessel.

12. The reflector lamp of claim 11 wherein the outer jacket has a tubular shape and a base end, and the light absorbing layer extends circumferentially around the outer jacket and lengthwise towards the base end.

13. The reflector lamp of claim 10 wherein the discharge vessel is symmetric about an axis and has a second capillary containing a second electrode assembly and a second electrode seal, the capillaries extending outwardly from the body of the discharge vessel in opposite directions along the axis.

14. The reflector lamp of claim 10 wherein electrode seal covers about 5 mm of the electrode assembly.

15. The reflector lamp of claim 10 wherein the electrode seal is comprised of a frit material.

16. The reflector lamp of claim 10 wherein the light absorbing layer comprises a refractory light-absorptive paint applied to the exterior surface of the outer jacket.

17. The reflector lamp of claim 10 wherein the light absorbing layer is continuous in the region of the outer jacket adjacent to the electrode seal.

18. The reflector lamp of claim 17 wherein the light absorbing layer covers the length of the electrode seal.

19. The reflector lamp of claim 16 wherein the light absorbing light starts at a point between 0.1 mm and 2 mm below the body of the discharge vessel.

20. The reflector lamp of claim 19 wherein the light absorbing layer is continuous in the region of the outer jacket adjacent to the electrode seal and covers the length of the electrode seal.

* * * * *